US006216494B1

(12) United States Patent
Essig et al.

(10) Patent No.: US 6,216,494 B1
(45) Date of Patent: Apr. 17, 2001

(54) METHOD OF PRODUCING A KNITTED ARTICLE

(75) Inventors: Horst Essig, Huelben; Oliver Vogt, Reutlingen, both of (DE)

(73) Assignee: H. Stoll GmbH & Co., Reutlingen (DE)

( * ) Notice: Subject to any disclaimer, the term of this patent is extended or adjusted under 35 U.S.C. 154(b) by 0 days.

(21) Appl. No.: 09/358,239

(22) Filed: Jul. 21, 1999

(30) Foreign Application Priority Data

Jul. 24, 1998 (DE) ..... 198 33 392

(51) Int. Cl.[7] ..... D04B 7/34
(52) U.S. Cl. ..... 66/65; 66/174
(58) Field of Search ..... 66/45, 64, 65, 66/69, 169 R, 170, 171, 174, 173

(56) References Cited

U.S. PATENT DOCUMENTS 3,916,647 * 11/1975 Yabuta ..... 66/65
5,239,846 * 8/1993 Kitaura et al. ..... 66/174
5,444,995 * 8/1995 Benetton ..... 66/64
5,943,884 * 8/1999 Kobata et al. ..... 66/176
5,987,930 * 11/1999 Nakai ..... 66/69
6,065,311 * 5/2000 Essig et al. ..... 66/64
6,085,553 * 7/2000 Schmidt et al. ..... 66/69

FOREIGN PATENT DOCUMENTS 1 277 782 6/1972 (GB) .
2 183 264 6/1987 (GB) .

* cited by examiner

*Primary Examiner*—Danny Worrell
(74) *Attorney, Agent, or Firm*—Michael J. Striker

(57) ABSTRACT

A method for producing a knitted article with a spatial main knitted element and at least one spatial partial knitted element on a flat knitting machine with at least two opposite needle beds, a needle displacement device and a loop transfer device, the method has the steps of producing the main knitted element and the at least one partial knitted element parallel on the machine until at least the partial knitted element is finished and the main knitted element reaches a point of coupling with the at least one partial knitted element, connecting loops of the main knitted element and the at least one partial knitted element by a transfer technique with one another, and then arranging loops of the at least one partial knitted element by the needle bed displacement device on one needle bed opposite to the loops of the main knitted element on the other needle bed, with which they must be connected.

20 Claims, 7 Drawing Sheets

FIG. 3.1A
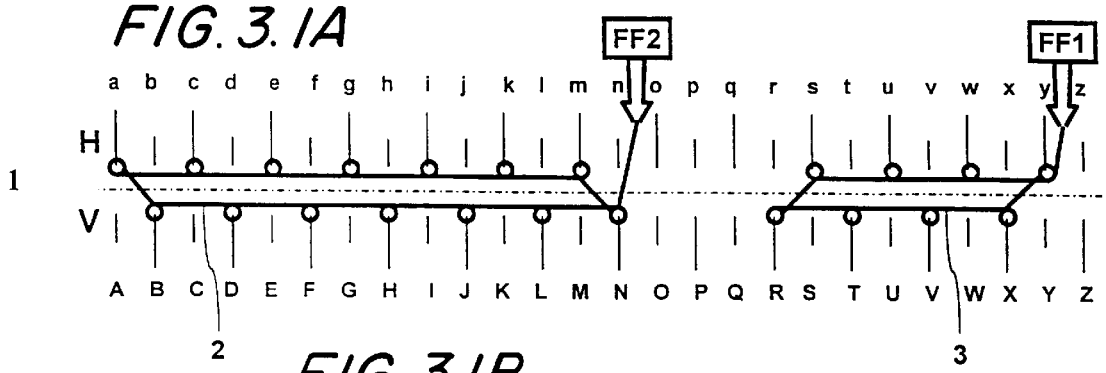
FIG. 3.1B
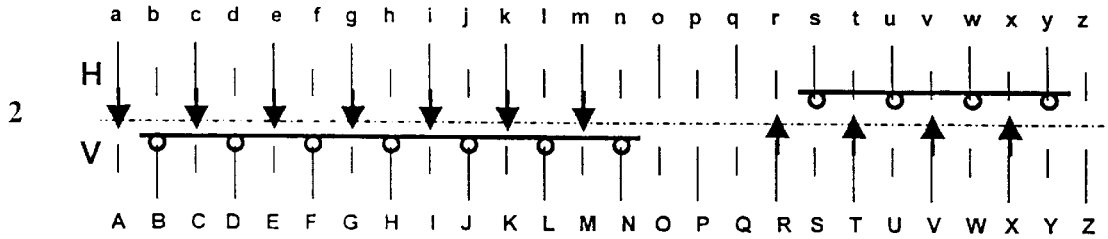
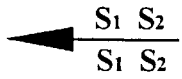
FIG. 3.1C
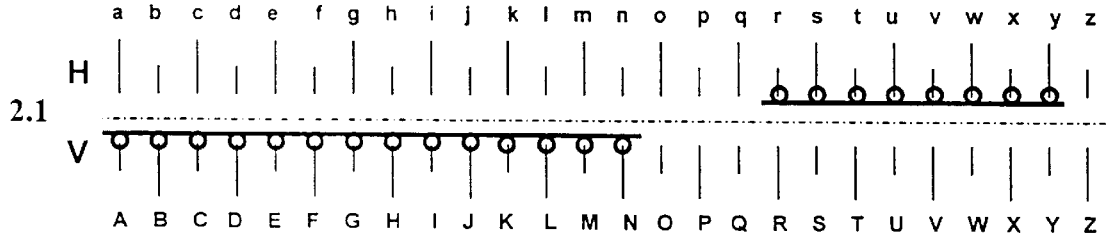
FIG. 3.1D
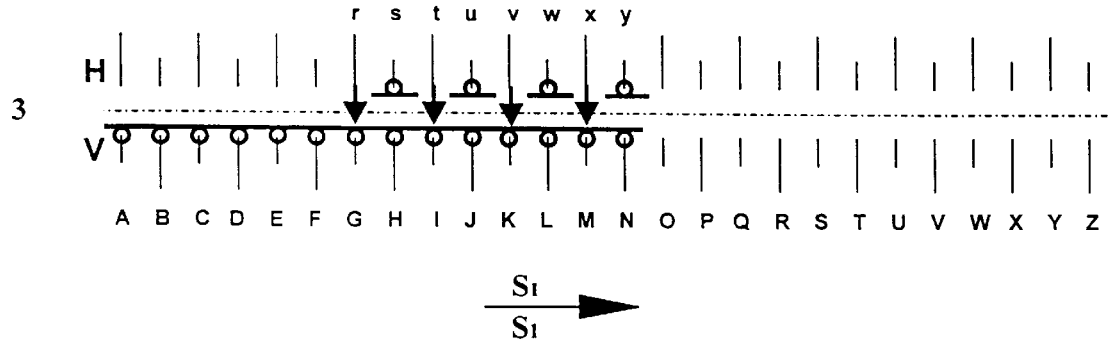

FIG. 3.2A
3.1
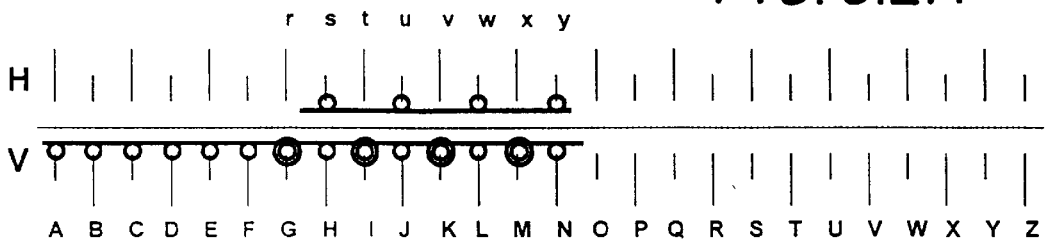
FIG. 3.2B
4
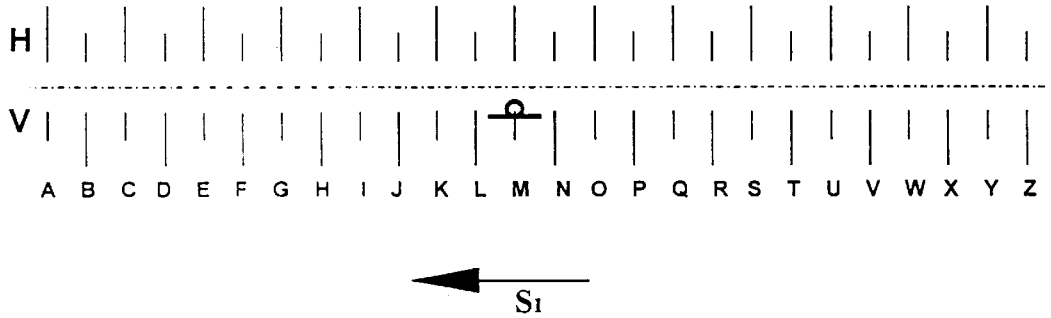
FIG. 3.2C
5
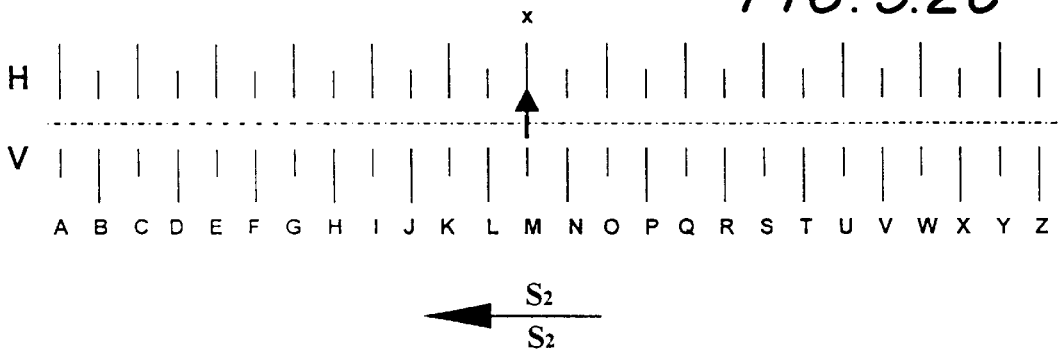
FIG. 3.2D
6
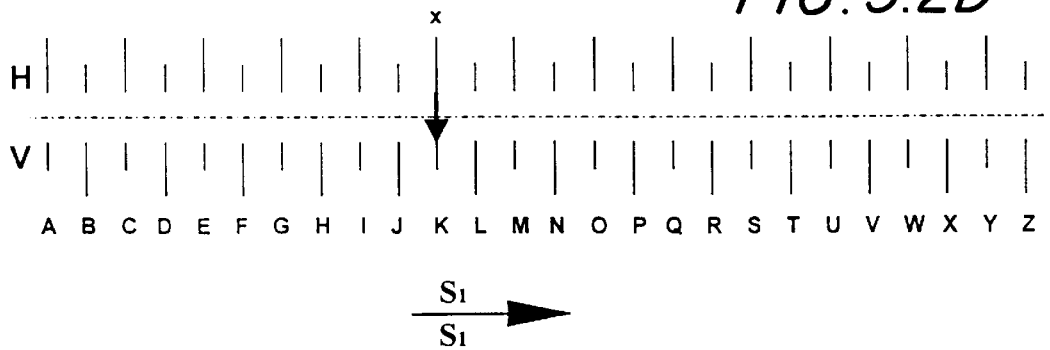

FIG. 3.3A
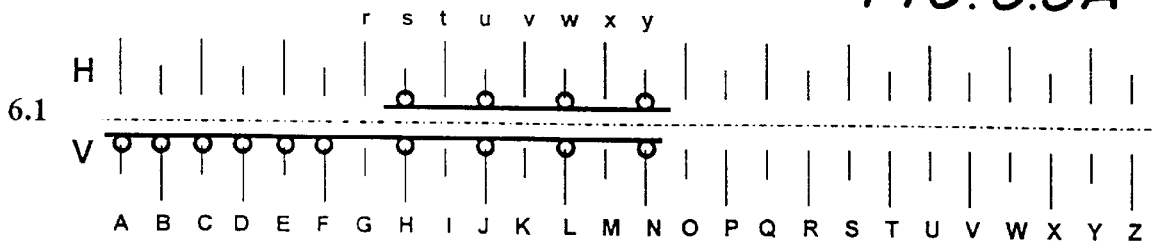
FIG. 3.3B
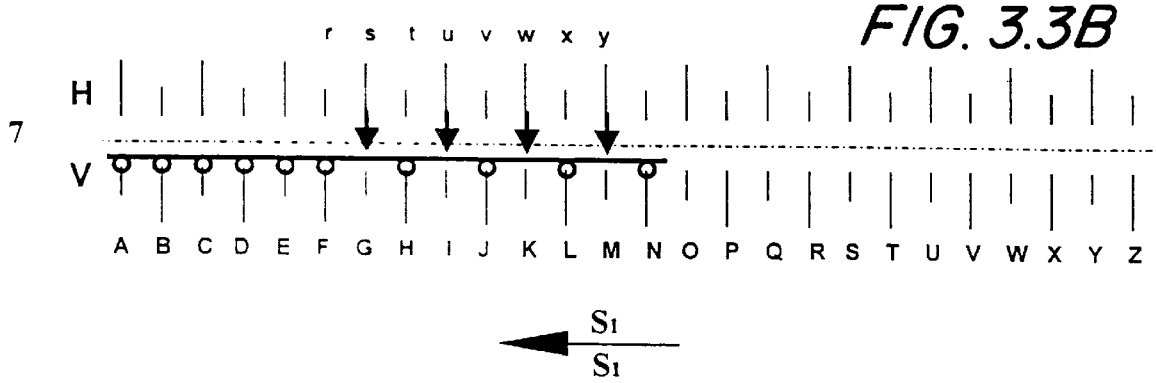
FIG. 3.3C
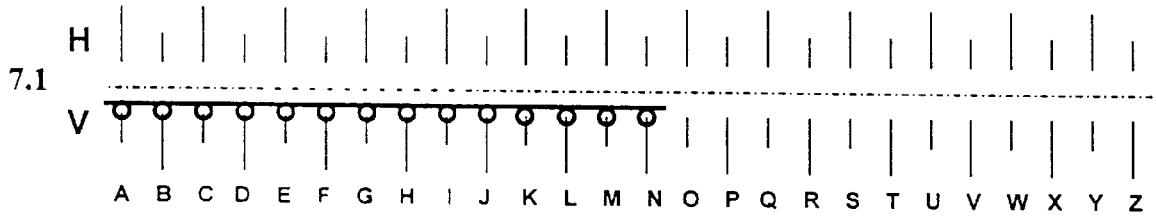
FIG. 3.3D
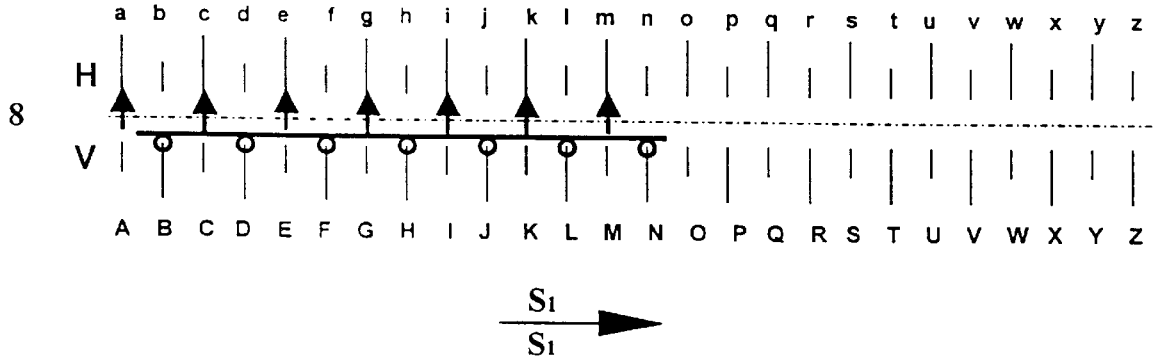

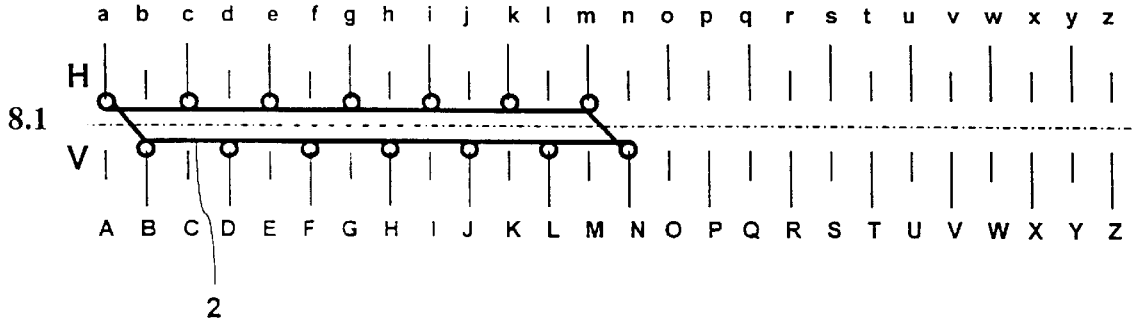
FIG. 3.4

METHOD OF PRODUCING A KNITTED ARTICLE

BACKGROUND OF THE INVENTION

The present invention relates to a method for producing a knitted article with a spatial main knitted element and at least one spacial partial knitted element, on a flat knitted machine with at least two oppositely located needle beds, a needle bed racking (displacing) device and a loop suspending device.

It has been possible to connect flat partial knitted elements of any geometry on a flat knitting machine directly with one another. Spatial partial knitted elements which are knitted separately, such as for example the hand part and the thumb of a glove must be connected with one another by sewing or linking manually after removal of the parts from the knitting machine. These manual post-treatment steps are however time consuming and expensive.

SUMMARY OF THE INVENTION

Accordingly, it is an object of the present invention to provide a method for producing a knitted article which avoids the disadvantages of the prior art.

In keeping with these objects and with others which will become apparent hereinafter, one feature of present invention resides, briefly stated in a method of producing a knitted article, in which the main knitted article and at least one partial knitted article are produced parallel on the machine until the at least one partial knitted article is finished and the main knitted article reaches a point of coupling with at least one partial knitted article, and then the loops of the main knitted element and the loops of the at least one partial knitted element are connected with one another by a suspension-linking technique after the loops of the at least one partial knitted element are arranged by the needle bed displacement device on one needle bed opposite to the loops of the main knitted element on the other needle bed, with which they must be connected.

When the method is performed in accordance with the present invention, first of all it is possible to produce knitted articles which are composed of several, mutually connected spatial partial knitted elements, completely on a flat knitting machine. Manual post-treatment steps are required only for cleaning. Preferably, at least immediately before the connection, the at least one partial knitted element and the main knitted element are knitted with at most each second needle of one needle bed, and an empty needle of the other needle bed is located opposite to a knitting needle of the one needle bed. Then, sufficient empty needles are available for the loop suspension step.

Depending on the type of the knitted article to be produced, the main knitted element and the at least one partial knitted element can be connected with one another so that the main knitted element at the connecting point with the at least one partial knitted element has an opening in its outer surface, whose cross-sectional area corresponds in shape and size to the connecting cross-sectional area of the at least one partial knitting element. When the knitted article however must have at the connecting point a draping or a pattern-like protruberance, this can be achieved by a deviation of the cross-sectional area of the opening of the main knitted element in shape and size from the connecting cross-sectional area of the at least one partial knitted element.

The main knitted element and/or the at least one partial knitted element can be formed as single or double-layer knitted articles. The main knitted element and the at least one partial knitted element can be knitted both as open or as also close hollow bodies. In order to produce them, it is advantageous when the main knitted element and the at least one partial knitted element are knitted with separate thread guides.

Further advantages are obtained when the main knitted element and the at least one partial knitted element are knitted closely to one another on the flat knitting machine, since then the required displacement movements of the needle beds for connecting the partial knitted element to the main knitted element are minimized. With several partial knitted elements, those partial knitted elements which must first be connected with the main knitted element are formed closer to the main knitted element than those partial knitted elements which can be connected later. During displacement of the inwardly located partial knitted article in direction of the main knitted element, the outer partial knitted element can be moved also further to the main knitted element, so that later during its connection to the main knitted element only small needle bed displacement movements are needed.

For obtaining lowest possible knitting times, the main knitted element and the at least one partial knitted element are formed in the same sliding direction. Moreover, the main knitted element and the at least one knitted element can be formed with a knitting technique with shortest possible sliding block reverse times.

The at least one partial knitting element can be connected at any vertical and peripheral position to the main knitted element. If at least one partial knitted element must be connected at the point located at the edge of the main knitted element and extending over both needle bed planes, the main knitted element can be turned by advancing loop transfer, until the connecting point is located only in one needle bed plane before the at least one partial knitted element is connected.

The present invention also deals with a knitted article with is produced by the inventive method. The connection opening of the knitted article between the main knitted element and the at least one partial knitted element can have any shape and can be arranged at any angle to the knitting direction. Moreover, the at least one partial knitting element can form any angle with the outer surface of the main knitted element. The knitted article can be for example a glove with a knitted thumb or a technical knitted article.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a view schematically showing a loop course of an inventive process for connecting a partial knitted element to a main knitted element;

DESCRIPTION OF PREFERRED EMBODIMENTS

Figure 1:
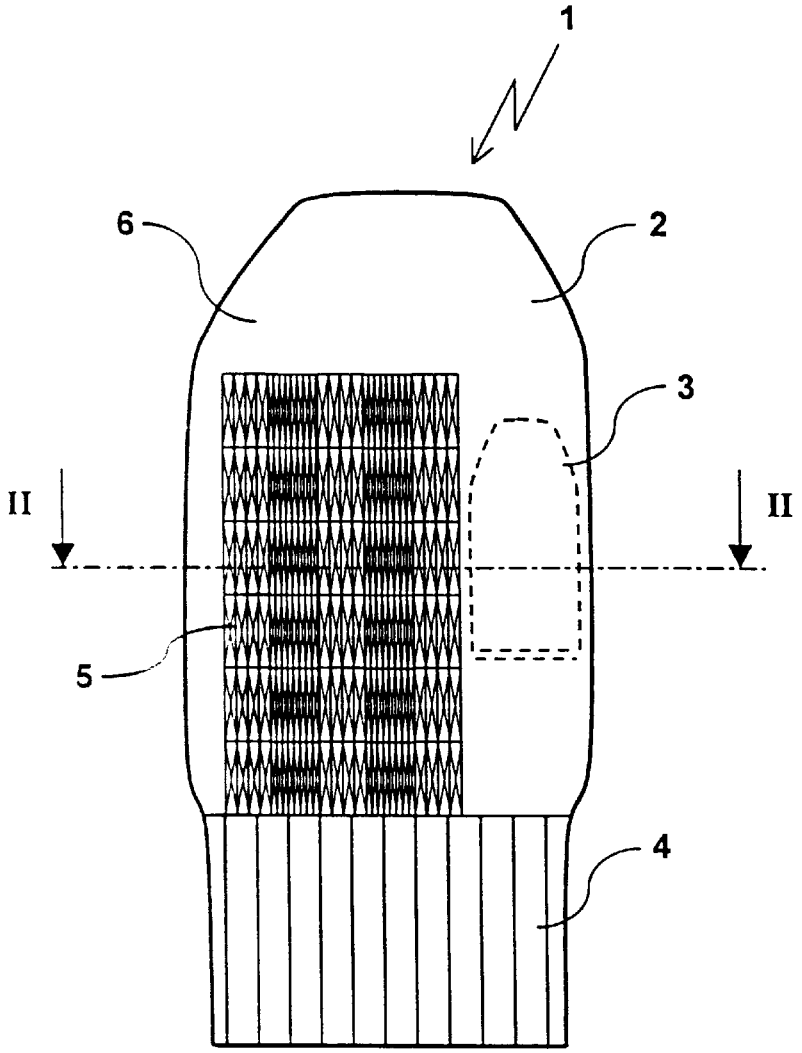
FIG. 1 is a view showing a fist glove with a knitted thumb.
Figure 2:
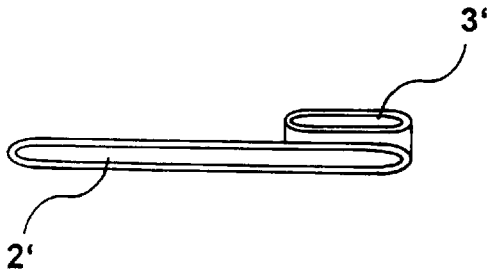
FIG. 2 is a view showing a section along the line II—II through the glove of FIG. 1.

FIG. 1 shows a fist glove 1 with a main knitted element 2 which surrounds the hand and a partial knitted element 3 which surrounds a thumb and is knitted to the main knitted element 2. The glove 1 is also provided with a sleeve 4 as well as with a structure pattern 5 in the region of the hand back. As can be seen from FIG. 2, both the main knitted element 2 and the partial knitted element 3 are spatial knitted articles which are connected with one another so that their inner spaces communicate with one another.

The connection of the thumb partial knitted element 3 to the main knitted element 2 can be performed for example in accordance with a method which is illustrated in FIG. 3. Row 1 of the loop course of FIG. 3 shows the loop arrangement of the main knitted element 2 and the partial knitted element 3, in accordance with which the last knitting row for these both elements 2 and 3 is formed. The main knitted element 2 is knitted with the thread guide FF2 and the partial knitted element 3 is knitted with the thread guide FF1. The loops of the both knitted elements 2 and 3 lay correspondingly only on each second needle of a needle bed V, H, while each empty needle (illustrated by a short line) of the other needle bed V, H, is located opposite to the loop-carrying needles (identified with long lines). In row 2, in a knitting direction from the right to left, with a first knitting system C1, the loops of the partial knitted element 3 located on the front needle bed V are transferred over to the rear needle bed H. With the next knitting system S2, the loops of the main knitted element 2 located on the rear needle bed H are transferred to the front needle bed V. Thereby now all loops of the partial knitted element 3 are located on the rear needle bed H, and all loops of the main knitted element 2 are located on the front needle bed V as shown in row 2.1. Then in row 3, by a needle bed displacement it is obtained that all loops of the partial knitted element 3 are located opposite to the loops of the main knitted element 2. After this, in row 2, the loops transferred to the rear needle bed H are again transferred back to the front needle bed V on the same needles, which already carry the loops of the rear knitted plane of the main knitted article 2. In row 3.1 the loop arrangement is shown in accordance with the transfer operation. The needles covered with two loops are identified by double crosses.

The rows 4–6 show only the linking technique, with which the loops of the partial knitted element 3 are connected with the loops of the main knitted element 2. In row 4 in the knitting direction from right to left, the double loops are knitted with the first knitting system S1 onto the needle M. Then in the same knitting direction, in row 5 the new formed loops M are transferred with the next knitting system S2 to the rear needle bed on the needle x. After the displacement of the rear needle bed H by two pitches to the left, in row 6 the loop located on the needle x is transferred with the first knitting system S1 in the knitting direction from left to right to the loop which is located on the needle K. Subsequently with the linking technique, the rows 4–6 are repeated until all double loops of the needles K, I and G are also linked. The thusly produced loop structure is shown in row 6.1.

In row 7, in direction from right to left, the loops of the rear plane of the partial knitted element 3 are transferred with the first knitting system S1 in the needles which become empty by the linking process onto the front needle bed V. Row 7.1 shows the loop arrangement after the transfer process. Subsequently, the rear needle bed H is again brought to its basic position, and in row 8 in the knitting direction from left to right, with the first knitting system S1 the loops of the rear plane of the main knitted element 2 are transferred back on the rear needle bed. Row 8.1 shows the loop arrangement after the transfer process. Subsequently, for the main knitted element 2, further loop rows are formed and finished or further partial knitted elements are connected in the same manner.

Figure 4:
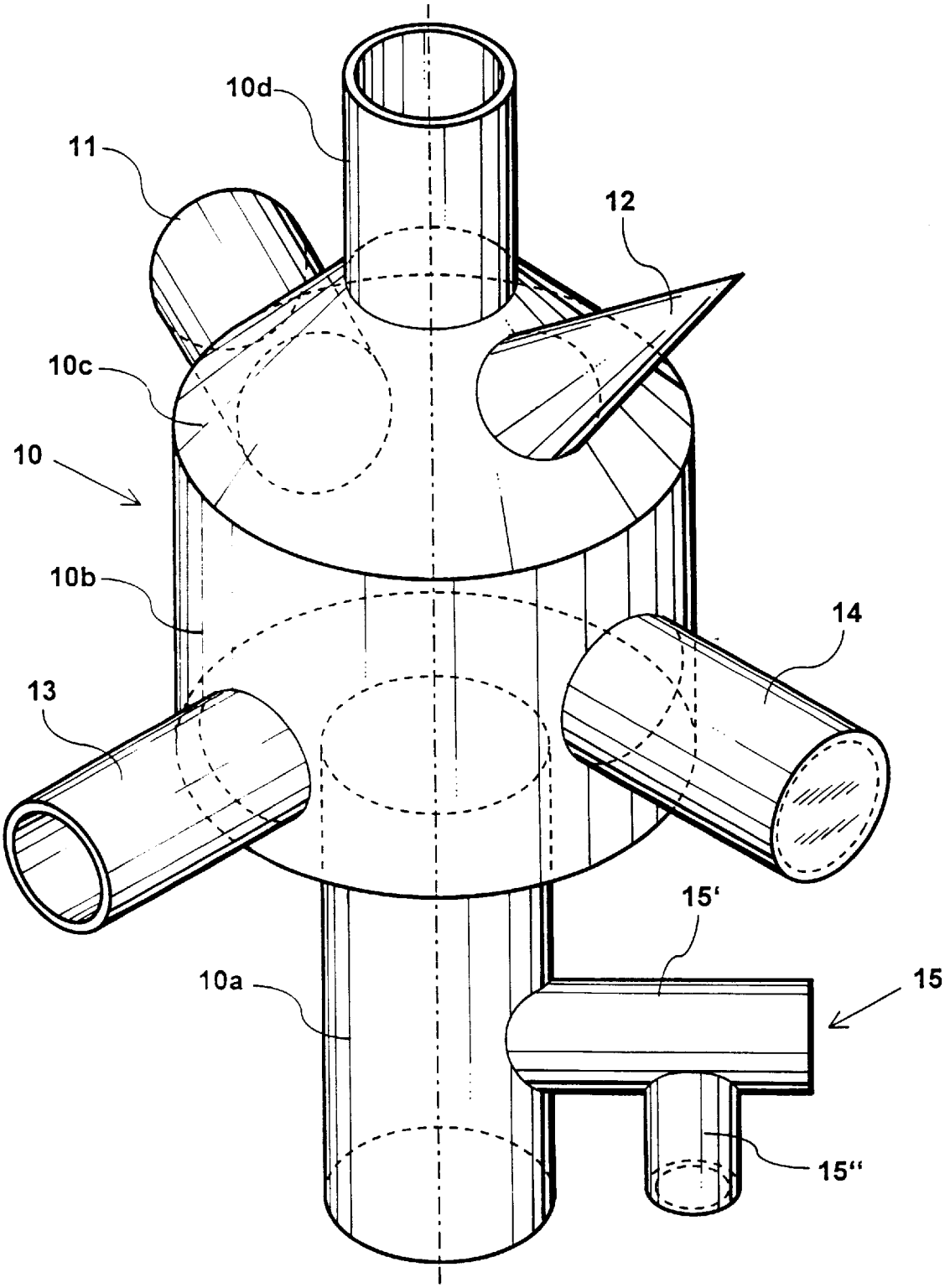
FIG. 4 is a perspective view of a further example of an inventive knitted article.

FIG. 4 shows the example of a knitted article 10 which illustrates a plurality of connecting possibilities implementable with the inventive method. The knitted article is composed in its lower region of a tube 10*a* of a medium diameter which is closed at its lower side. A further tubular part 15' is connected perpendicular to the tubular part 10*a*, and is in turn also connected with a tubular partial knitted element 15". During a manufacture of the arrangement 15, the partial knitted element 15' is connected to the main knitted element, to which the partial knitted element 15" is connected. At its upper end the tubular part 10*a* merges into a tubular part 10*b* of a greater diameter, with which an open tubular partial knitted article 13 and a closed tubular partial knitted particle 14 are connected. The tubular part 10*b* is closed by a conical part 10*c*, and a closed tubular part 11*a* as well as a conical part 12 laterally extend from it, while an open tubular part 10*d* is arranged on its tip.

Figure 5:
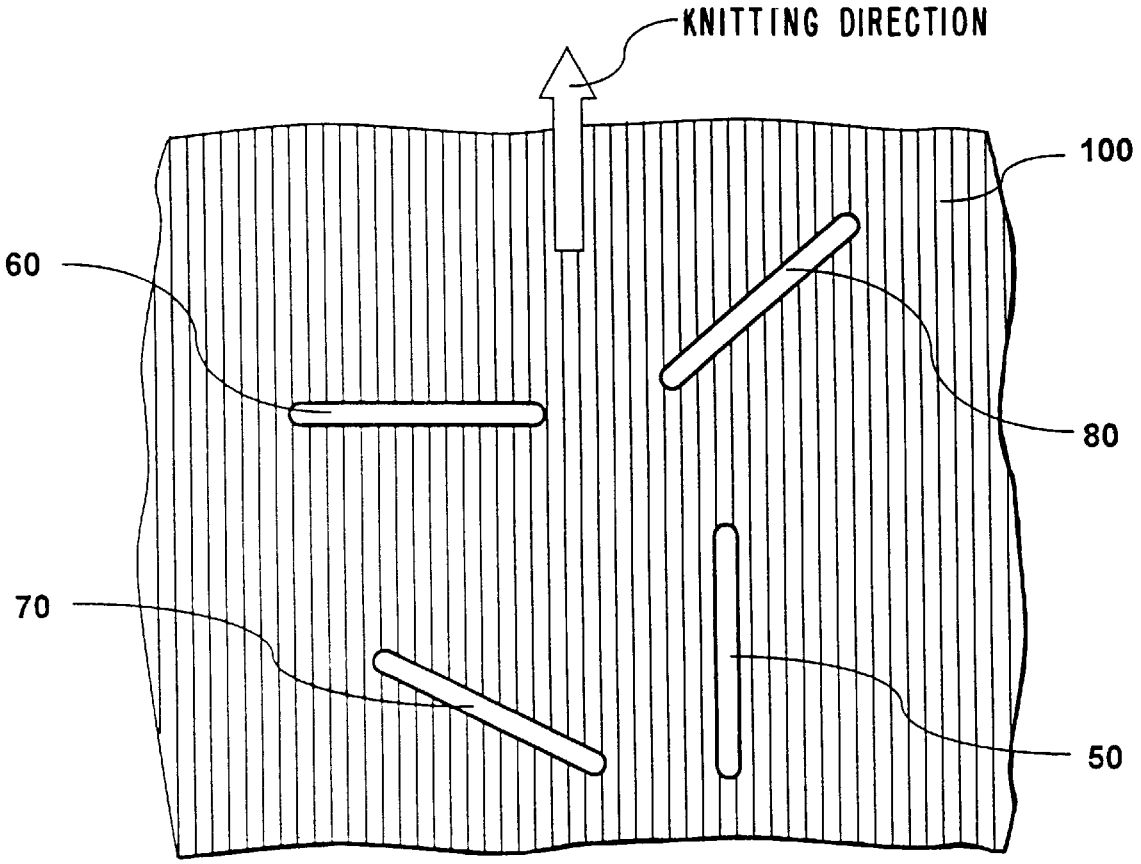
FIG. 5 is a partial inner view on a main knitted element with several connecting points to partial knitted elements.

The cutout of a surface of a main knitted element 100 from the inner side in accordance with FIG. 5 shows several connecting openings 50, 60, 70, 80 to not shown partial knitted elements. The openings 50, 60, 70, 80 are slot-shaped and form different angles to the knitting direction. With the inventive method, connecting openings can be produced with different shapes and positions.

It will be understood that each of the elements described above, or two or more together, may also find a useful application in other types of methods differing from the types described above.

While the invention has been illustrated and described as embodied in method of producing a knitted article, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A method for producing a knitted article with a spatial main knitted element and at least one spatial partial knitted element on a flat knitting machine with at least two opposite needle beds, a needle displacement device and a loop transfer device, the method comprising the steps of producing the main knitted element and the at least one partial knitted element parallel on the machine until at least the partial knitted element is finished and the main knitted element reaches a point of coupling with the at least one partial knitted element; connecting loops of the main knitted element and the at least one partial knitted element by a transfer-linking technique with one another; then arranging loops of the at least one partial knitted element by the needle bed displacement device ono one needle bed opposite to the loops of the main knitted element on the other needle bed, with which they must be connected; knitting, immediately before the connection of the at least partial knitted element, of the main knitting element with at most each second needle of one needle bed; and arranging an empty needle of the other needle bed opposite to a knitting needle of the one needle bed.

2. A method as defined in claim 1; and further comprising the steps of connecting the main knitted element and the at least one partial knitted element with one another so that the main knitted element at a connecting point with the at least one partial knitted element has an opening in its outer surface, with an opening cross-section area having a shape and a size corresponding to a connection cross-sectional area of the at least one partial knitting element.

3. A method as defined in claim 1; and further comprising forming the main knitted element as a knitted article selected from the group consisting of a single-surface knitted article and a double-surface knitted article.

4. A method as defined in claim 1; and further comprising forming the at least one partial knitted element as a knitted article selected from the group consisting of a single-surface knitted article and a double-surface knitted article.

5. A method as defined in claim 1, wherein the main knitted element and the at least one partial knitted element are knitted as a body selected from the group consisting of an open body and a closed body.

6. A method as defined in claim 1; and further comprising the step of knitting the main knitted element and the at least one partial knitted element with separate thread guides.

7. A method as defined in claim 1; and further comprising knitting the main knitted element and the at least one partial knitted element closely to one another on the flat knitting machine.

8. A method as defined in claim 1; and further comprising the step of forming the main knitted element and the at least one partial knitted element in a same knitting direction.

9. A method as defined in claim 1; and further comprising the step of forming the main knitted element and the at least one partial knitted element with a knitting technique with a shortest possible slide reverse time.

10. A method as defined in claim 1; and further comprising locating the at least one partial knitted element on an edge of the main knitted element and connecting via points extending through both needle bed planes, by turning the main knitting element by progressing loop transfer until a connecting point is located only in one needle bed plane before the at least one partial knitted element is connected.

11. A method for producing a knitted article with a spatial main knitted element and at least one spatial partial knitted element on a flat knitting machine with at least two opposite needle beds, a needle displacement device and a loop transfer device, the method comprising the steps of producing the main knitted element and the at least one partial knitted element parallel on the machine until at least the partial knitted element is finished and the main knitted element reaches a point of coupling with the at least one partial knitted element; connecting loops of the main knitted element and the at least one partial knitted element by a transfer-linking technique with one another; then arranging loops of the at least one partial knitted element by the needle bed displacement device ono one needle bed opposite to the loops of the main knitted element on the other needle bed, with which they must be connected; using several partial knitting elements; and forming those partial knitted elements which must be connected first with the main knitted element closer to the main knitted element, than those partial knitted element which must be connected later.

12. A method as defined in claim 11; and further comprising the steps of connecting the main knitted element and the at least one partial knitted element with one another so that the main knitted element at a connecting point with the at least one partial knitted element has an opening in its outer surface, with an opening cross-section area having a shape and a size corresponding to a connection cross-sectional area of the at least one partial knitting element.

13. A method as defined in claim 11; and further comprising forming the main knitted element as a knitted article selected from the group consisting of a single-surface knitted article and a double-surface knitted article.

14. A method as defined in claim 11; and further comprising forming the at least one partial knitted element as a knitted article selected from the group consisting of a single-surface knitted article and a double-surface knitted article.

15. A method as defined in claim 11, wherein the main knitted element and the at least one partial knitted element are knitted as a body selected from the group consisting of an open body and a closed body.

16. A method as defined in claim 11; and further comprising the step of knitting the main knitted element and the at least one partial knitted element with separate thread guides.

17. A method as defined in claim 11; and further comprising knitting the main knitted element and the at least one partial knitted element closesly to one another on the flat knitting machine.

18. A method as defined in claim 11; and further comprising the step of forming the main knitted element and the at least one partial knitted element in a same knitting direction.

19. A method as defined in claim 11; and further comprising the step of forming the main knitted element and the at least one partial knitted element with a knitting technique with a shortest possible slide reverse time.

20. A method as defined in claim 11; and further comprising locating the at least one partial knitted element on an edge of the main knitted element and connecting via points extending through both needle bed planes, by turning the main knitting element by progressing loop transfer until a connecting point is located only in one needle bed plane before the at least one partial knitted element is connected.

* * * * *